US008459738B2

(12) United States Patent
Downey

(10) Patent No.: US 8,459,738 B2
(45) Date of Patent: Jun. 11, 2013

(54) PORTABLE BACKREST FOR A PERSON SEATED SIDEWAYS ON A SOFA

(76) Inventor: Kyle Downey, Elwood, IN (US)

( * ) Notice: Subject to any disclaimer, the term of this patent is extended or adjusted under 35 U.S.C. 154(b) by 69 days.

(21) Appl. No.: 13/180,686

(22) Filed: Jul. 12, 2011

(65) Prior Publication Data

US 2013/0014327 A1 Jan. 17, 2013

(51) Int. Cl.
*A47C 7/02* (2006.01)
*A47C 20/00* (2006.01)

(52) U.S. Cl.
USPC ..... 297/230.1; 5/632; 5/634; 297/230.11; 297/230.12; 297/230.13; 297/352

(58) Field of Classification Search
USPC ..... 5/632, 634; 297/230.1, 230.11, 230.12, 297/230.13, 352
See application file for complete search history.

(56) References Cited

U.S. PATENT DOCUMENTS

| | | | | | |
|---|---|---|---|---|---|
| 513,735 | A | * | 1/1894 | Russell | 297/183.1 |
| 878,889 | A | * | 2/1908 | Miller | 297/352 |
| 1,238,782 | A | * | 9/1917 | Kaye | 297/230.11 |
| 2,005,972 | A | * | 6/1935 | Gallop | 5/632 |
| 2,071,155 | A | | 2/1937 | Alexander | |
| 2,429,795 | A | * | 10/1947 | Blanchard et al. | 297/118 |
| 2,491,784 | A | | 12/1949 | Thompson | |
| 4,022,502 | A | | 5/1977 | Smith et al. | |
| 4,185,342 | A | * | 1/1980 | Young | 5/634 |
| 4,363,517 | A | * | 12/1982 | Scott | 297/377 |
| 4,908,891 | A | | 3/1990 | Blagg | |
| 5,121,961 | A | * | 6/1992 | Marshall | 297/17 |
| 5,425,567 | A | * | 6/1995 | Albecker, III | 297/377 |
| 5,921,627 | A | * | 7/1999 | Risetter | 297/293 |
| 6,250,712 | B1 | * | 6/2001 | Livington et al. | 297/4 |
| 6,374,440 | B1 | * | 4/2002 | Thim, Jr. | 5/633 |
| 7,104,607 | B2 | * | 9/2006 | Yasuda et al. | 297/354.1 |
| 7,275,273 | B2 | * | 10/2007 | Lary et al. | 5/634 |
| 7,412,737 | B2 | * | 8/2008 | Hernadez | 5/655 |
| 7,478,445 | B2 | * | 1/2009 | De Vries | 5/601 |
| 7,758,119 | B1 | * | 7/2010 | Baterdouk | 297/230.1 |

* cited by examiner

*Primary Examiner* — William Kelleher
*Assistant Examiner* — Eric Kurilla
(74) *Attorney, Agent, or Firm* — Bruce J. Bowman

(57) ABSTRACT

A portable backrest gives upper body support to a person sitting sideways on a sofa or like furniture, the portable backrest placed and retained on the sofa through a cushion of the sofa on which the person eventually sits. A lower, support or base portion of the portable backrest forming a bracket that is received under and around a part of the cushion that is adjacent an armrest of the sofa while an upper portion of the portable backrest extends upwardly and outwardly from the lower portion and armrest to support the upper body, neck and head of a sitting person. In one form, a back portion of the backrest is pivotally connected to a lower portion of the backrest while in another form, the back portion is integral with the lower portion. The upper portion may have back, neck and head cushioning.

2 Claims, 6 Drawing Sheets

PORTABLE BACKREST FOR A PERSON SEATED SIDEWAYS ON A SOFA

BACKGROUND OF THE INVENTION

1. Field of the Invention

The present invention relates to portable devices for supporting the upper body of a person when seated and, more particularly, pertains to a portable device for supporting the upper body of a person when seated sideways on a sofa.

2. Background Information

Sofas and other like pieces of furniture are designed to allow a person to sit facing forward with their upper body supported by a back of the sofa. The typical sofa also has an armrest at each end or side thereof that allows the seated person to rest their arm and/or provide a barrier to prohibit the seated person from falling off the end or side of the sofa. Like other types of seating, the sofa is designed to support the back or upper body of the seated person while that person is seated facing forward. Of course, a person may lie down on the sofa wherein the person's head is proximate one armrest and their feet are proximate the other armrest.

There are times however, rather than being totally supine, when a person sits on a sofa in a sideways or "longways" position such that the seated person's legs are supported by the cushions of the sofa and an arm of the sofa is proximate or abuts the seated person's lumbar region of the back. The sideways position provides a lap for the person while elevating the legs and thus is well suited for reading, laptop and tablet use, watching television, and more. A downside to the sideways position is that there is no support for the back, neck and/or head. Thus, sitting in this manner can soon become uncomfortable and/or create stress on the back, neck and/or head (upper body). However, because sitting sideways on a sofa is oftentimes desirable, it would be nice to have back, neck and head support when so seated. Currently, there is no portable back, neck and head support device for a person sitting sideways on a sofa or other like furniture. Because a sofa and other like furniture has removable cushions and side arms, prior art devices are not satisfactory.

For instance, a device that provides a portable seat and back for a stadium bench seat is disclosed in U.S. Pat. No. 2,491,784 issued Dec. 20, 1949 to Thompson. Thompson utilizes a metal frame having first and second legs each one of which extends over the top, around the side and under a portion of the bench in order to grasp the bench and support a seat spanning the first and second legs. The first and second legs continue to become first and second arms that connect at a lateral upper portion thereof and which support a back that spans between the first and second arms. A lower lateral member is connected between the first and second legs for frame stability. The rigidity of the bench and the frame provide support for the seat and particularly the sear back. Such a frame system however, would not be usable with a sofa and particularly usable with the flexible cushions of a sofa and its armrests. Thus, such a frame would not be usable as a back, neck and head support for a person sitting sideways on a sofa.

U.S. Pat. No. 2,071,155 issued Feb. 16, 1937 to Alexander describes a cushion support for a side-less bed or couch in order for the cushion to be displayed in an upright position. A single piece wire frame defines L-shaped side members joined by an upper cross bar, base portions extending generally normal to the side members and joined by a lower cross bar, and extensions substantially parallel with the base portions. The base portions and the lower cross bar lie under the mattress with the edge of the mattress, fitting between the base portions and the extensions so that the support is in effect, clamped on the mattress. The cushion is supported on the extensions, side members and upper cross bar. Such a flimsy frame system however, would not be usable as a back, neck and head support for a person sitting sideways on a sofa.

In U.S. Pat. No. 4,022,502 issued May 10, 1977 to Smith et al. describes an arm or cushion support (i.e. an arm cushion) for furniture and particularly side-less sofas (e.g. "day-bed" sofas). A frame extends under the seat cushion of the furniture and has two upstanding back frame members. An armrest or cushion is retained by the two upstanding back frame members. Again, such a frame system however, would not be usable as a back, neck and head support for a person sitting sideways on a sofa.

In view of the above, it is thus desirable to have a portable backrest that provides upper body support of a person sitting sideways on a sofa or other like furniture.

SUMMARY OF THE INVENTION

The present invention is a portable backrest that provides upper body support of a person sitting sideways on a sofa or like furniture. The portable backrest has a lower portion configured for placement under and around a part of a cushion of the sofa adjacent an armrest of the sofa, and an upper portion configured for supporting an upper body, neck and head of the sitting person.

The lower portion is formed by a base plate and a transverse member while the upper portion is formed by a back plate. In one form, the back plate is pivotally connected to the transverse member while in another form, the back plate is integral with the transverse member. The back plate may be at least somewhat resilient allowing it to flex upon the sitting person leaning against the upper portion.

In the adjustable form, the angle of the upper portion of the backrest relative to the lower portion of the backrest (and thus the sofa) is variable. This makes the angle of the upper portion of the backrest relative to the arm of the sofa variable. In all forms however, the upper portion is preferably, but not necessarily, cushioned. Such cushioning also preferably, but not necessarily, forms a neck and head rest.

Currently, in a preferred form, the base plate, transverse member and the back plate are formed of a solid piece of material. Suitable material includes metal, carbon fiber, composite, plastic and the like. In one form, the portable backrest may be formed of a single piece of material with upper body cushioning, as described above, provided on the upper portion thereof.

BRIEF DESCRIPTION OF THE DRAWINGS

The above mentioned and other features, advantages and/or objects of this invention, and the manner of attaining them, will become apparent and the invention itself will be better understood by reference to the following description of embodiments of the invention taken in conjunction with the accompanying drawings, wherein.

Like reference numerals indicate the same or similar parts throughout the several figures.

A description of the features, functions and/or configuration of the components depicted in the various figures will now be presented. It should be appreciated that not all of the features of the components of the figures are necessarily described. Some of these non-discussed features, if any, as well as discussed features are inherent from the figures. Other non-discussed features may be inherent in component geometry and/or configuration.

DETAILED DESCRIPTION OF EMBODIMENTS OF THE INVENTION

Figure 1:
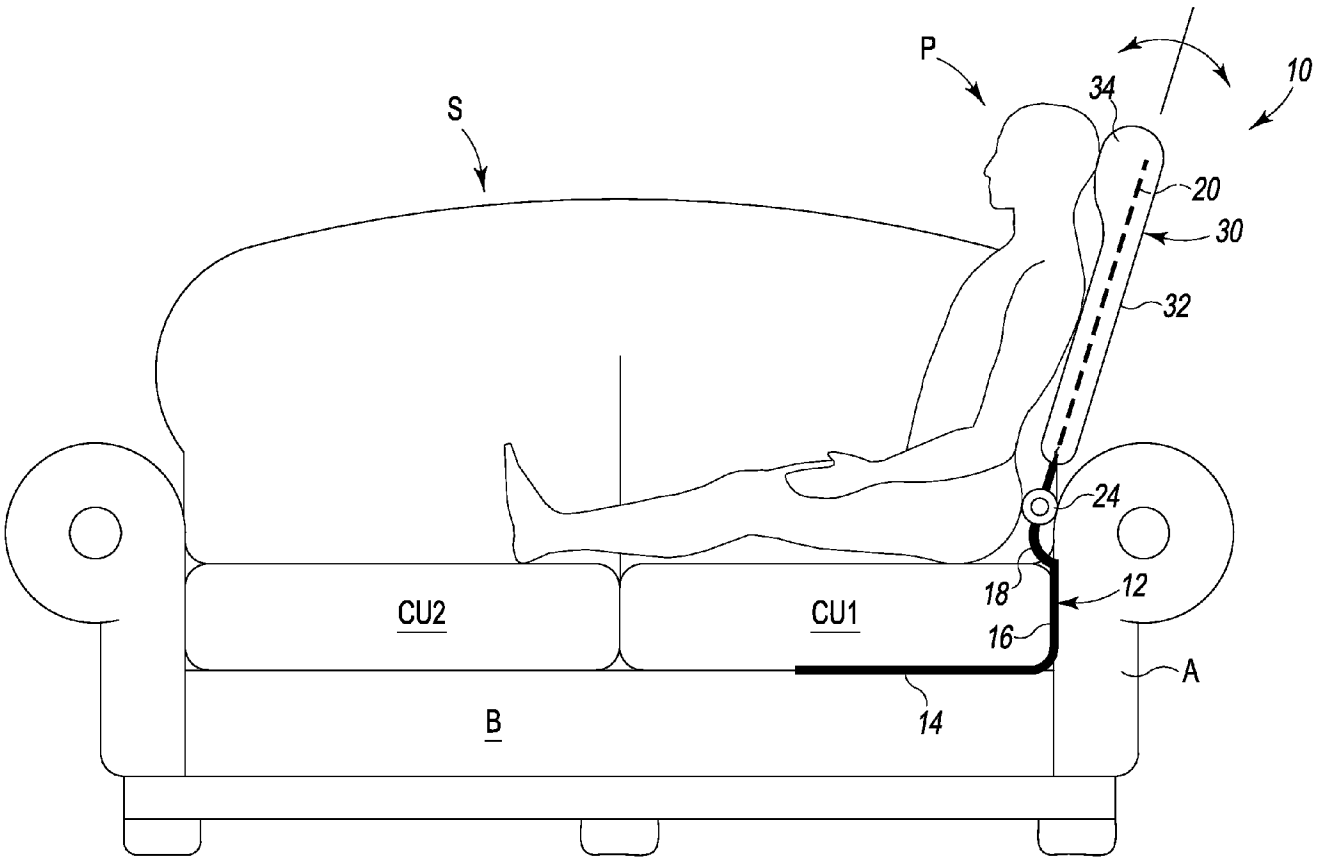
FIG. 1 is a front isometric view of an exemplary sofa with a person sitting thereon sideways and using the present backrest.
Figure 2:
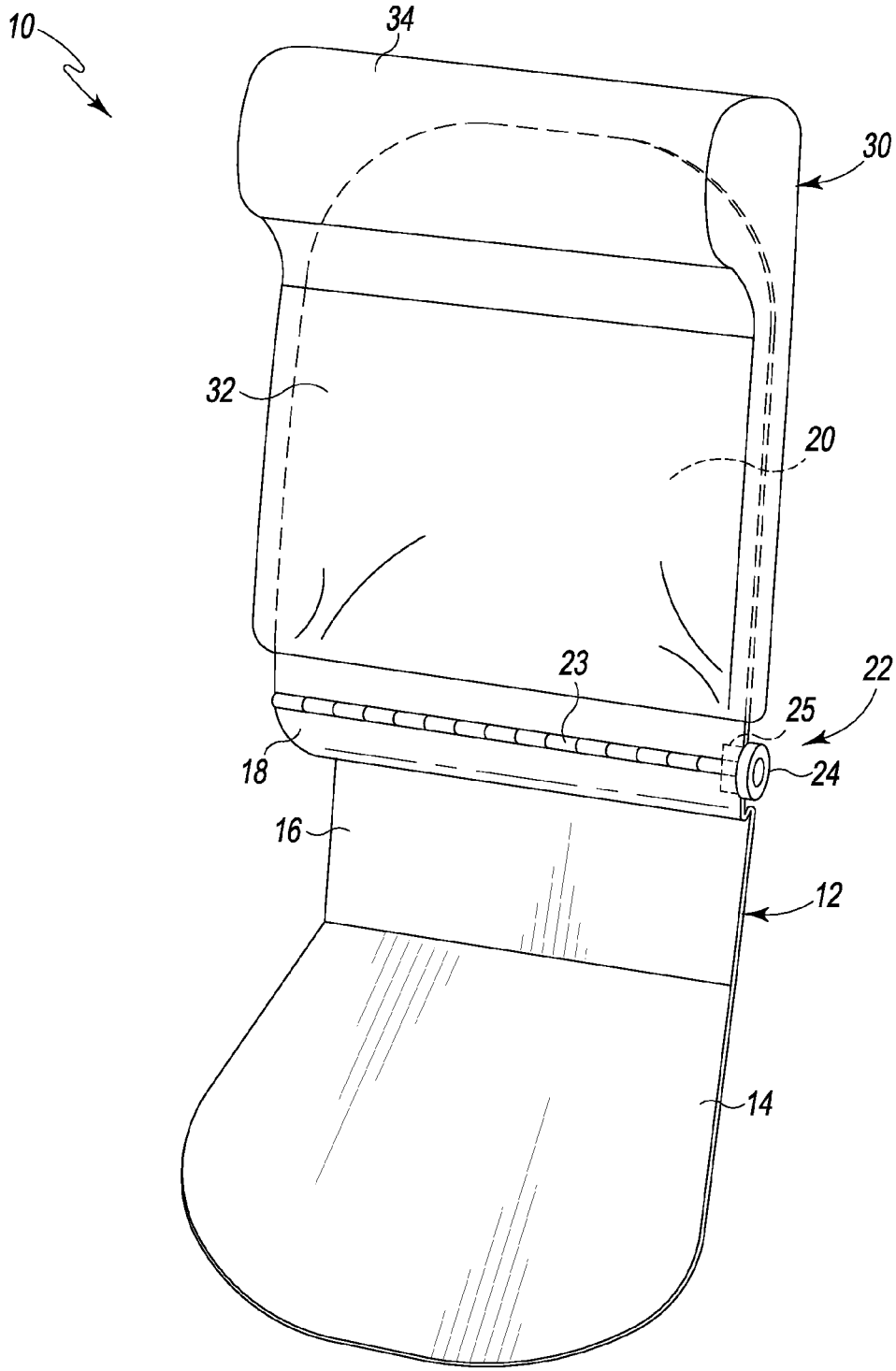
FIG. 2 is a front isometric view of the present backrest of FIG. 1.

Referring to FIG. 1, there is depicted a person P sitting sideways on a sofa S, the sofa S being representative of all types of sofas, couches, divans, davenports and the like on which the present invention may be used. Therefore, it should be appreciated that the present invention is not limited for use on just the particular piece of furniture chosen for the illustration of FIG. 1 (i.e. sofa S). The sofa S has a base or frame B that supports two removable cushions CU1 and CU2. While the sofa S is shown with two cushions, it should be appreciated that the particular piece of furniture may have one or more removable cushions. The sofa S further has a left side arm or armrest and a right side arm or armrest (labeled A) each one of which extends a vertical distance upwards from its respective side of the sofa.

As shown in FIG. 1 a backrest 10, fashioned in accordance with the present principles and portable, is situated on the sofa S with the person P seated sideways on the sofa such that the backrest 10 is supporting the torso and head (upper body) of the person P. The backrest 10 is supported, held and/or retained on the sofa through the cushion CU1 and the armrest A. Sitting on the cushion CU1, the person P adds ballast to the cushion CU1 for additional retention of the backrest 10 on the sofa S. Weight of the seated person P on the cushion CU1 also counteracts weight against and supported by a back or back portion of the backrest. The back may be resilient to allow flexing thereof, stiff as to not allow flexing thereof and/or adjustably positionable in angle relative to a base portion of the backrest and of the armrest A. Such is represented by a centerline and the forward and backward arced arrows above the back of the backrest 10 shown in FIG. 1.

Referring additionally to FIGS. 2-5, various views of the backrest 10 are shown. The backrest 10 has a body 12 formed of a strong material such as metal, plastic, carbon fiber, composite or the like. Also, depending on its form, the material may be somewhat resilient in order to allow limited flexure. The body 12 has a lower portion defined by a generally planar base 14, a generally planar rear 16 and an arced transition portion 18, and an upper portion defined by a generally planar back 20 extending generally vertical from the arced transition portion 18. The base 14 is also preferably, but not necessarily, curved at its end. The planar back 20 is preferably but not necessarily, overlaid with a cushion 30 or the like having a back cushion portion 32 and a headrest 34. The cushion 30 may be any type of cushion material and/or cushioning such as is known in the art. The cushion 30 may be integral with the back 20 or may be removable from the back 20. Moreover, the cushion 30 may include indicia, patterns, designs, etc. as desired.

The lower portion of the backrest 10 interfaces with the sofa S and particularly the cushion CU1 and armrest A in that the lower portion is received under and around a part of the cushion CU1 that is adjacent the armrest A. Particularly, the base 14 is received under the cushion CU1 while the rear 16 extends up the side of the cushion CU1 and adjacent the armrest A, the outside of the rear 16 abutting the armrest A or sofa side. The transition portion 18 arcs inwardly and upwardly about the upper surface of the cushion CU1 at its end. In this manner, a rectangular pocket or area that accommodates a cushion is formed. Additionally, the configuration of the base, rear and transition portion positively receives and holds the end of the cushion. Preferably, but not necessarily, both the base 14 and the rear are formed of a solid piece of material. Additionally, the base and rear may be created from a single piece of material or from several pieces of material joined together.

Figure 3:
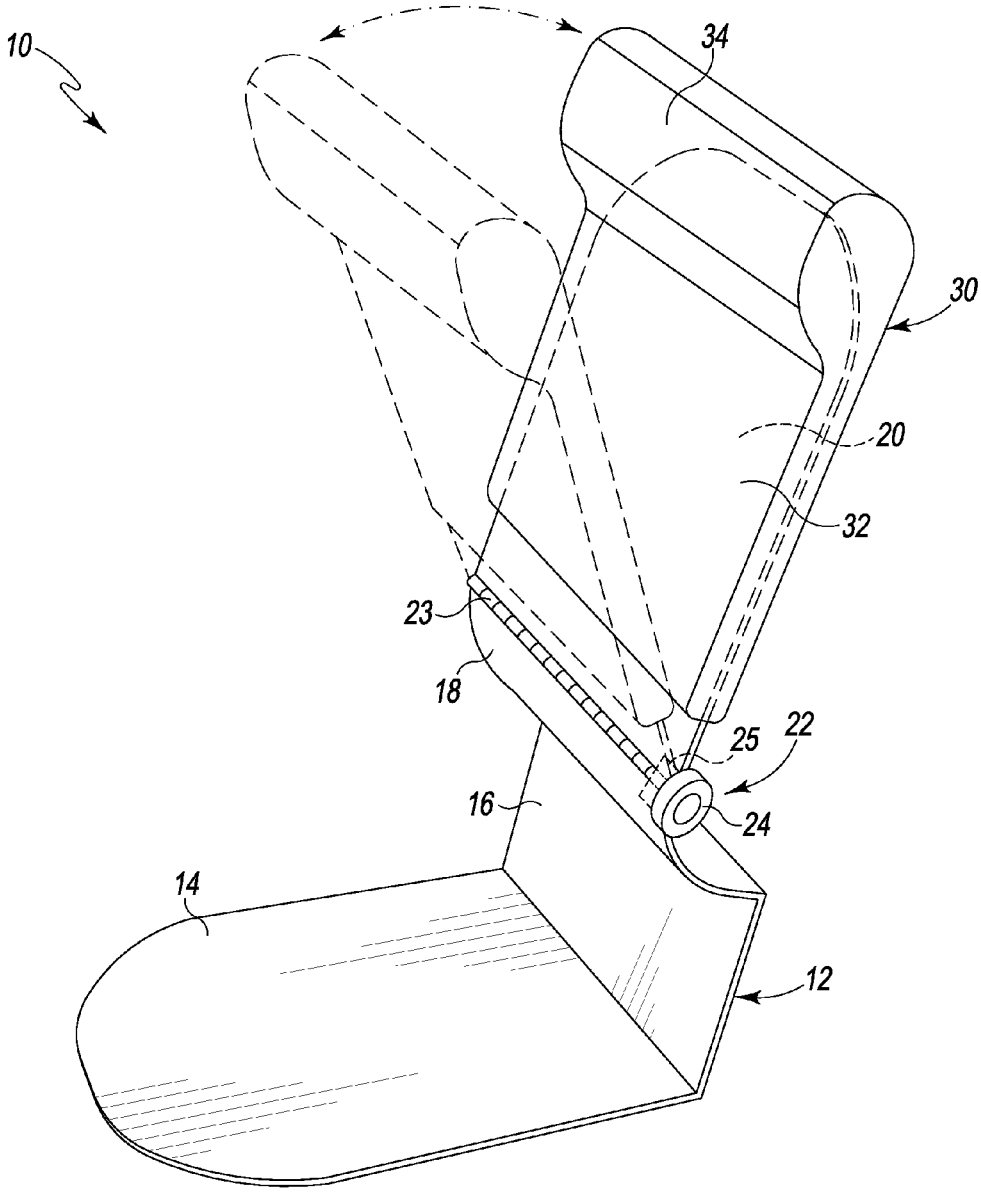
FIG. 3 is a front side isometric view of the present backrest of FIG. 1.
Figure 4:
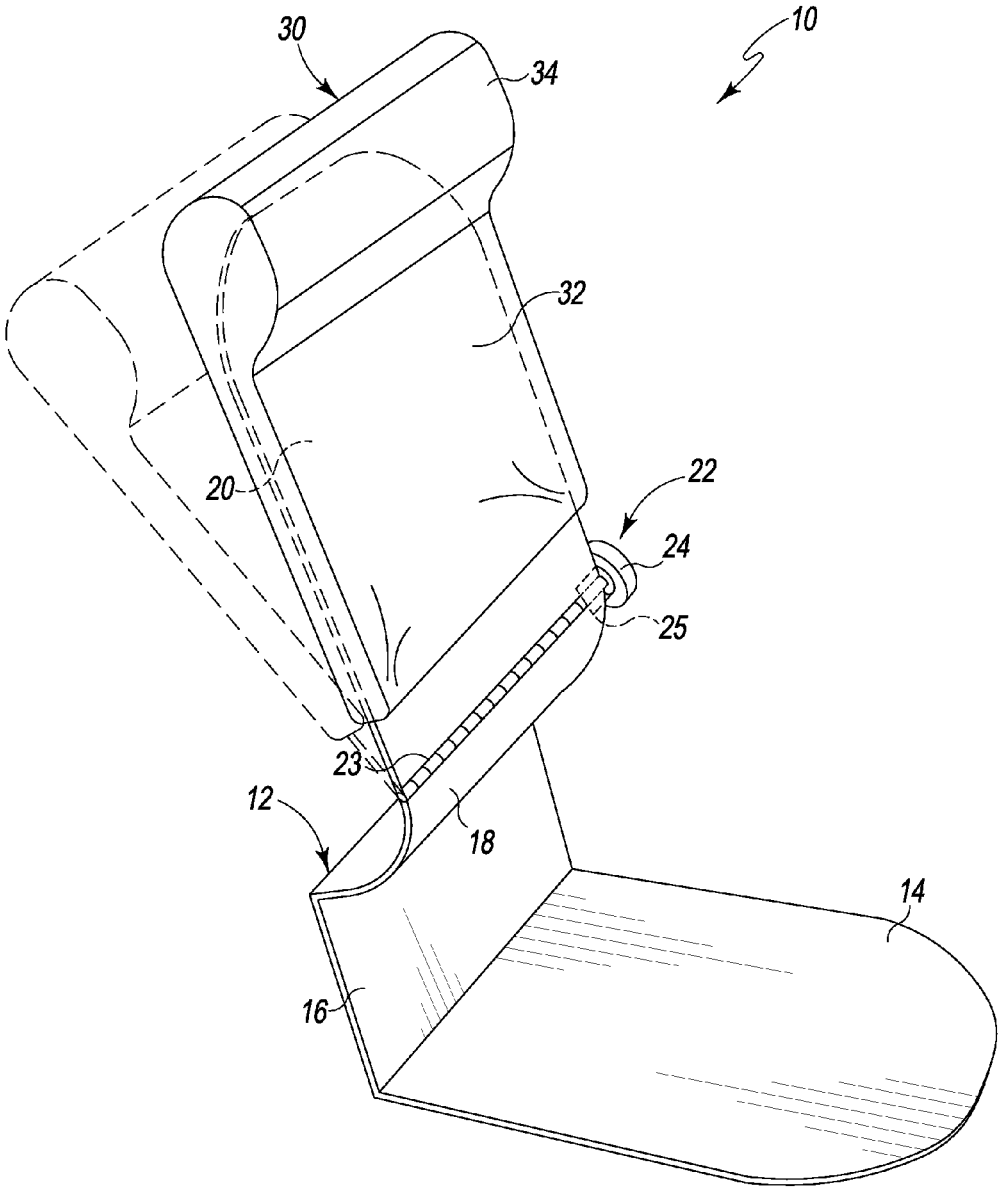
FIG. 4 is another front side isometric view of the backrest of FIG. 1 illustrating the ability of the backrest to adjust backwards of an upright position.
Figure 5:
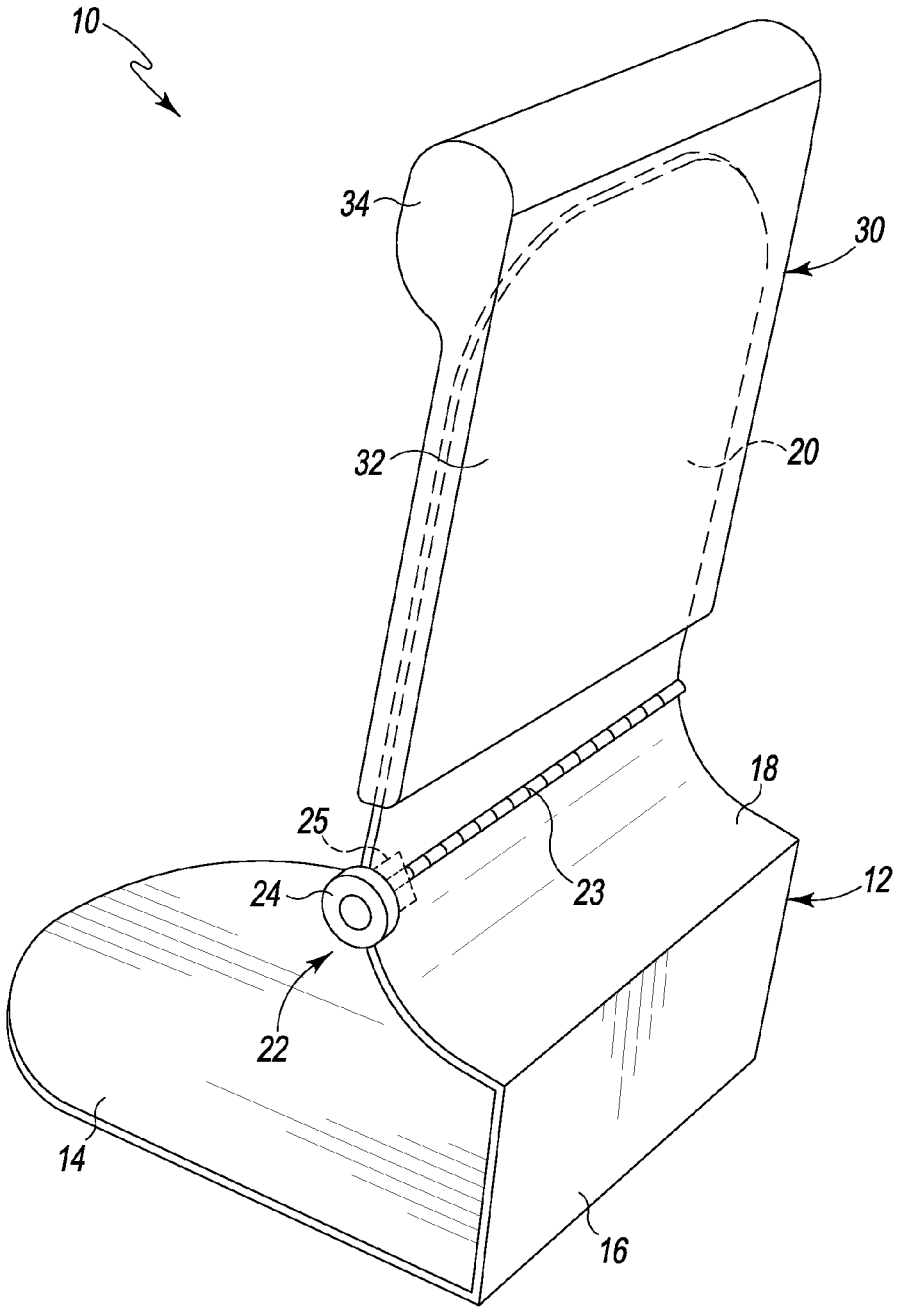
FIG. 5 is a rear side isometric view of the backrest of FIG. 1 illustrating the ability of the backrest to adjust forwards of an upright position.

The back 20 is preferably, but not necessarily, formed of a solid piece of material that is again preferably, but not necessarily, curved at its end. The back 20 is connected to the transition portion 18 (lower portion) via a coupling 23 and tilt adjustor 22 that allows the back 20 to adjust forward (as illustrated in FIG. 3) and backward (as illustrated in FIG. 4) relative to the transition portion 18 (lower portion) and thus the armrest A (sofa). The coupling 23 is shown as a hinge but other types of couplings may be used to provide pivoting between the lower portion and the upper portion of the backrest 10. The tilt adjustor 22 controls the angle of the back 20 and includes knob 24 and adjustment mechanism 25. The knob 24 is coupled to the adjustment mechanism 25 and allows the user to change and set the angle of the back 20. The adjustment mechanism 25 may provide incremental or discrete angle adjustment and setting thereof for the back 20 (e.g. a ratchet or detent type mechanism) or the adjustment mechanism 25 may be continuous and provide infinite angle adjustment over a range of angles and setting thereof for the back 20 (e.g. a spring-loaded stop mechanism). Other adjustment mechanisms and/or manner of adjustment may be used and are contemplated.

Figure 6:
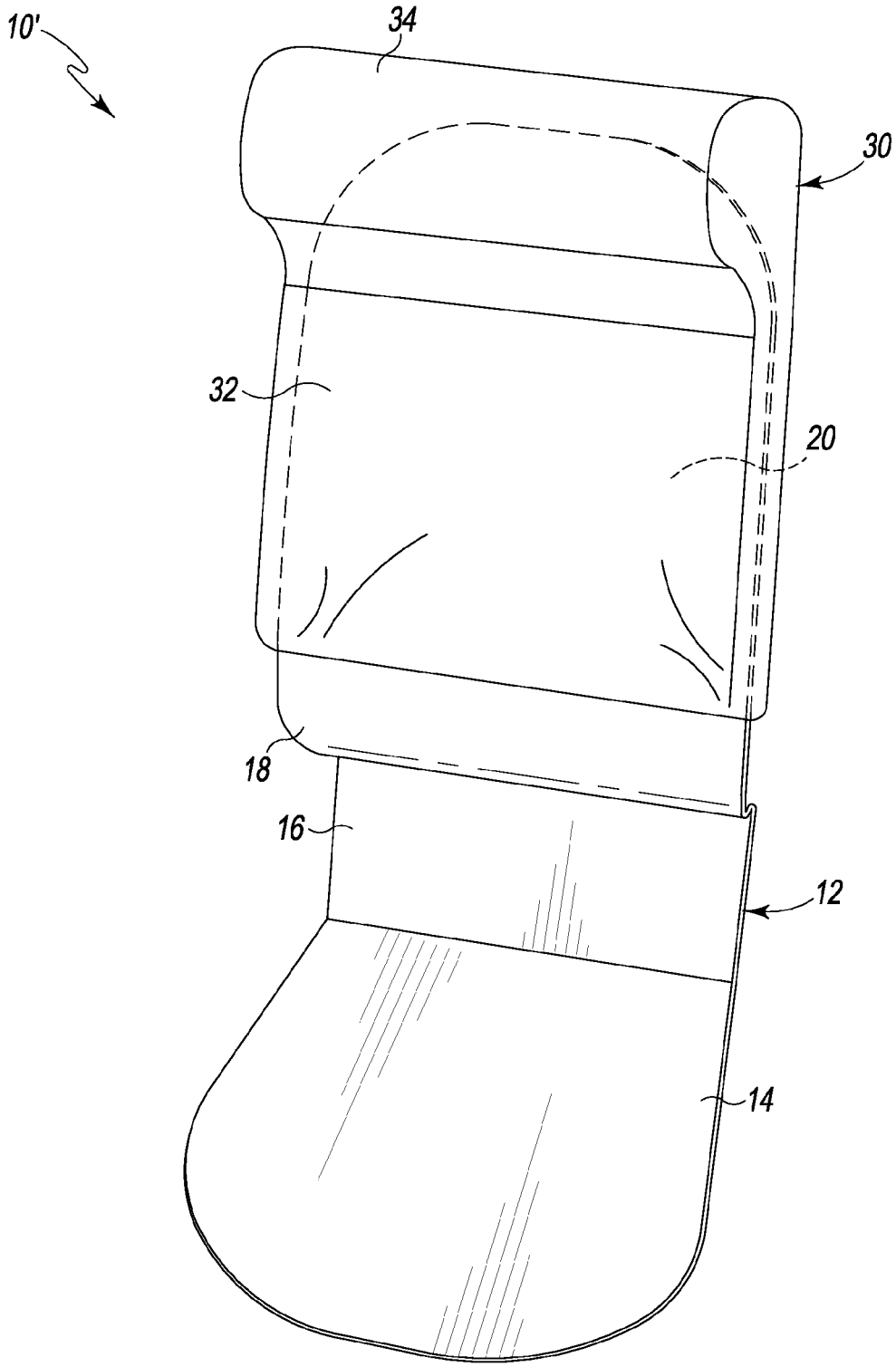
FIG. 6 is a front isometric view of an alternate embodiment of a backrest fashioned in accordance with the present principles.

Referring now to FIG. 6, there is depicted an alternate embodiment of the present portable backrest generally designated 10'. Instead of a pivot between the transition portion 18 and the back 20 as per the backrest 10 of FIGS. 1-5, the backrest 10' is continuous between the transition portion 18 and the back 20. This provides a spring or flex joint between the transition portion and the back since the material for the body 12 is resilient. Preferably, the body 12 is formed of a single piece of resilient material. The back 20 of the backrest 10' thus flexes backwards upon the application of body weight as when the person is sitting per FIG. 1. The backrest 10' may be made with or without the cushion 30.

In another form but still referring to FIG. 6, the backrest 10' may be formed of a single piece (i.e. the base 14, the rear 16, the transition portion 18, and the back 20) but made of a generally rigid material that provides little or no flexure. In this form, the angle of the back is generally fixed relative to the lower portion and thus the sofa/armrest.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

What is claimed is:

1. A portable backrest for supporting an upper body of a person sitting sideways on a sofa, the portable backrest comprising:

a single piece of resilient material comprising:

a planar base plate having a front end and a rear end and configured to support a cushion that is adjacent an armrest of the sofa, a planar rear plate, having an upper end and a lower end, the lower end of the planar rear plate extending from the rear end of the planar base plate such that the planar rear plate is perpendicular to the planar base plate, a transition portion situated at the upper end of the planar rear plate and defining a flex junction having a first portion that angles inwardly perpendicular to the planar rear plate and a second portion that extends upwardly therefrom substantially parallel to the planar rear plate, and a planar back extending from the second portion of the flex junction portion and configured to support a torso of a user sitting sideways on the sofa, the flex junction allowing backwards flexure upon application of body weight of the torso of the user on the planar back, the planar base plate, the planar rear plate and the transition portion forming a generally rectangular reception area that is configured to receive an end of the cushion that is adjacent the armrest of the sofa; and a cushion situated on and about the planar back.

2. The portable backrest of claim 1, wherein the cushion includes a headrest.

* * * * *